US005199472A

United States Patent [19]

Rollison

[11] Patent Number: 5,199,472

[45] Date of Patent: Apr. 6, 1993

[54] VOLUMETRIC CLOSED CHEMICAL TRANSFER SYSTEM

[75] Inventor: Gil Rollison, Memphis, Tenn.

[73] Assignee: Gilco Sales, Inc., Memphis, Tenn.

[21] Appl. No.: 651,627

[22] Filed: Feb. 6, 1991

[51] Int. Cl.[5] ..... B65B 31/04

[52] U.S. Cl. ..... 141/65; 141/51; 141/59; 141/18; 141/95; 222/65; 222/67; 222/152; 222/444; 33/370

[58] Field of Search ..... 141/65, 51, 40–43, 141/47–49, 59, 95, 18; 222/65, 67, 444, 152, 450, 451, 157, 158; 33/370, 371, 377–379; 73/1 H

[56] References Cited

U.S. PATENT DOCUMENTS

| | | | |
|---|---|---|---|
| 969,090 | 8/1910 | Culbertson et al. | 141/95 X |
| 1,419,880 | 6/1922 | Mauclere | 141/18 |
| 1,925,248 | 9/1933 | Hill | 222/158 |
| 2,221,487 | 11/1940 | Moore | 222/444 X |
| 2,563,930 | 8/1951 | Hamann et al. | 222/67 |
| 2,600,518 | 6/1952 | Ruth | 33/370 |
| 2,614,742 | 10/1952 | Price | 141/59 X |
| 3,386,175 | 6/1968 | Stockman | 33/371 X |
| 3,455,346 | 7/1969 | Stork | 141/42 |
| 3,763,570 | 10/1973 | Andersen | 33/370 |
| 3,940,063 | 2/1976 | Baumgartner et al. | 141/18 X |
| 3,976,087 | 8/1976 | Bolton et al. | 141/59 X |
| 4,148,610 | 4/1979 | Miller, Jr. et al. | 141/59 X |
| 4,741,368 | 5/1988 | Crumby | 141/18 |
| 4,869,301 | 9/1989 | Ohmi et al. | 141/98 X |
| 4,945,955 | 8/1990 | Murphy | 141/65 |
| 5,002,154 | 3/1991 | Chen | 141/65 X |

FOREIGN PATENT DOCUMENTS

| | | | |
|---|---|---|---|
| 0522410 | 4/1931 | Fed. Rep. of Germany | 141/47 |
| 0345128 | 3/1931 | United Kingdom | 141/65 |

*Primary Examiner*—Henry J. Recla
*Assistant Examiner*—Casey Jacyna
*Attorney, Agent, or Firm*—Breiner & Breiner

[57] ABSTRACT

A self-contained, portable, closed, chemical transfer system is described. The system includes a support frame, a container, a vacuum pump, a leveling means for the container, a valved inlet line, and a valved outlet line. The leveling means allows for use of the portable, self-contained system on various surface levels. The vacuum pump can provide solely a vacuum to the container of the system or can be structured to also provide pressure to the container of the system to facilitate emptying of the container. When a pressure means is not provided, gravity is utilized to facilitate emptying of the container. The vacuum pump of the invention which provides alternatively for both vacuum and pressure includes a single operating lever operatively connected to two 3-way valves which are used in conjunction with a motor, air pump, and appropriate air lines. The system is operated through the use of a minimal number of valves which provides for simple construction and operation.

8 Claims, 2 Drawing Sheets

VACUUM PUMP
EMPTY
FILL

VOLUMETRIC CLOSED CHEMICAL TRANSFER SYSTEM

FIELD OF THE INVENTION

The present invention is directed to a self-contained, portable, volumetric closed chemical transfer system which is useful in metering a chemical which is to be transferred from a first container to a second container as a batch. The volumetric closed chemical transfer system provides for the transfer of a chemical without requiring direct contact between the user of the system and the chemical being transferred.

BACKGROUND OF THE INVENTION

Chemical metering systems are known for receiving liquid chemicals from one source and transferring that chemical to a second source, especially in the field of agri-chemicals. Such chemicals are generally provided in concentrated form in a drum or the like and must be transferred into equipment which is utilized to distribute the chemical, i.e. sprayers or the like. Most such chemicals are toxic in their concentrated form and, therefore, are harmful if inhaled or brought into contact with a person's skin. Accordingly, closed chemical transfer systems are preferred for use. Generally, however, conventional closed chemical transfer systems are bulky, complex structurally, and/or difficult to handle and operate. Normally, a transfer system requires the use of a variety of couplings to provide a closed chemical system. These systems are, therefore, time consuming to utilize and require a fair amount of knowledge of the system to operate the system. Conventional systems are also generally not portable in and of themselves, but are permanently affixed to some means of mobility such as a truck or the like. Transfer systems known in the art also generally do not have a means of leveling the measuring container and, therefore, in order to be provided with an accurate measurement, a complex measuring device must be utilized rather than a sight gauge. If the transfer system is not level and only a sight gauge is used, an accurate measurement reading is not readily available.

For example, U.S. Pat. No. 3,976,087 discloses a closed chemical agriculture chemical batching, measuring, and mixing system. The system is mounted on a sprayer tending truck and relies on the intake manifold of the internal combustion engine of the truck to draw a partial vacuum on the measuring tank so that the tank can be filled with a liquid chemical. After the tank is filled, the vacuum is broken and the chemical discharged from the tank through a dump valve located in the bottom of the tank. Venting of gaseous fumes from the tank is accomplished by venting the fumes to the truck's engine where they are described as being rendered harmless.

U.S. Pat. No. 4,254,805 discloses a closed chemical mixing system wherein the system includes a plurality of chemical concentrate holding tanks, a mixing tank, a vacuum subsystem for creating a partial vacuum in the mixing tank, and a control system for transferring liquid from the holding tanks to the mixing tank. The liquid is then discharged from the mixing tank to its point of use, i.e., a sprayer.

U.S. Pat. No. 4,405,061 describes a filling machine for supplying predetermined quantities of liquids to containers. The filling machine includes a measuring chamber, a float means, an abutment means for limiting the upward movement of the float means, and a sealing means. As shown in FIG. 1 of the patent, a supply container is connected to a measuring chamber by a valved line. When the valve is opened, material in the supply container fills the measuring chamber. Thereafter, the valve is closed and another valve opened so that the material in the measuring chamber can be discharged into another container. A vacuum can be utilized with the measuring chamber to pull liquid from the supply container into the measuring chamber. The vacuum is released when the liquid is to be discharged. Atmospheric pressure and gravity or, in the alternative, air pressure can be utilized to discharge the liquid from the measuring chamber into the container. In one embodiment, a single piece float valve is used to control filling of the measuring chamber. In an alternative embodiment, a two-piece float is used so that the measuring chamber can be removed and replaced with chambers of varying volumes.

U.S. Pat. No. 4,638,925 describes an apparatus for metering and dispensing liquids. The measuring chamber of the apparatus includes a cylinder having top and bottom seals which are held in place against the open ends of the cylinder through the use of a plurality of tension bolts. An air vent is present in the top wall of the chamber to allow for exit of displaced air from the chamber during filling of the chamber with a liquid. The apparatus utilizes gravity to empty the material from the measuring chamber. The apparatus utilizes a single inflow/outflow valve. A float is used to cut off the inflow of liquid by sealing the air vent. This action is described as also preventing the overfilling of the measuring chamber.

U.S. Pat. No. 3,455,346 discloses a refueling apparatus for motor-driven machines which includes a pump for creating a vacuum in a fuel tank contained in the apparatus. A single valve is utilized to open the fuel tank to allow fuel to flow into the tank from a supply container. A float valve is used to prevent overfilling of the tank. When the chamber is full, the valve is closed and the pump turned off.

U.S. Pat. No. 1,685,409 discloses an apparatus for delivering measured quantities of liquid which includes a pump to force fluid into and out of a measuring vessel. The pump creates a suction to draw fluid into the vessel. A float and a quantity stop are present on a centrally positioned guide rod and are utilized to control the amount of fluid filled into and dispensed from the vessel. The vessel contains a vent pipe which can discharge into the atmosphere or back into the storage tank.

A chemical transfer apparatus currently commercially sold under the name Batch Boy® by Safe-Chem Company utilizes a jet assembly to create a vacuum in a measuring canister. The system apparatus is attached to the top of a drum or truck box containing a liquid to be transferred. The base of the apparatus includes a control panel, two inlets, and an outlet. One inlet is connected to the drum or truck box and a canister positioned on top of the base. The second inlet brings water or a fertilizer into the base where it will be mixed with the chemical transferred into the canister when the chemical is discharged from the canister. The outlet is used for discharging the chemical from the canister and the water or fertilizer to a sprayer unit. The measuring canister used in the apparatus is a unitary structure which can be disconnected for cleaning.

OBJECTS OF THE INVENTION

Accordingly, a primary object of the present invention is to provide a self-contained, portable, closed, chemical transfer system which is versatile and simple in operation.

Another primary object of the present invention is to provide a self-contained, portable, closed, chemical transfer system having a means for drawing a vacuum on the metering container present in the system to facilitate filling of the metering container with a liquid and a means for releasing the vacuum to allow for ready emptying of the metering container.

Another primary object of the invention is to provide a closed chemical transfer system wherein the means for drawing a vacuum is also capable of providing pressure to the metering container to facilitate emptying of the container no matter where the container is positioned thereby not requiring reliance on gravity for discharge of the material.

Another primary object of the present invention is to provide a portable, closed, chemical transfer system having a leveling means for the metering container of the system to allow the system to be used on various levels or terrain and still provide for an accurate metering of the chemical being transferred.

BRIEF DESCRIPTION OF THE INVENTION

The portable, self-contained, closed, chemical transfer system of the present invention includes a frame or support stand, a container, a means for providing a vacuum in the container, a leveling means for the container, a valved inlet line, and a valved outlet line.

The container is formed using a side wall structure, an upper flange, and a lower flange. The flanges and side walls are held together utilizing a plurality of vertically extending rods. The rods extend on the outside of the side walls and through each of the upper and lower flanges. The ends of the rods extending through the upper flange are then attached to another flange. This latter flange is in turn attached to a leveling means which includes a ball which is integral with the support frame and a handle. When the handle is turned counterclockwise, the container is loosened so that the position of the container can be adjusted to level the container. Once leveled, the handle is then turned clockwise to lock the container in place. A float leveling indicator is present on the uppermost flange so that an operator can determine whether the container is level or not. The bottom flange has an opening therein connected to a valved inlet line and a valved outlet line. A deflector is preferably positioned over the opening so that during filling of the container through the opening, splashing of the material entering the container is prevented. The container additionally has a sight gauge for visually determining the amount of liquid in the container. The upper flange abutting the container side walls additionally has an opening therein. A line extends through this opening and is connected to a pump means which is capable of drawing a vacuum in the container. The pump means is preferably a vacuum/pressure pump, i.e. is capable of drawing a vacuum or capable of applying pressure. The vacuum pump means can be an automated pump or, in an alternative embodiment, a hand pump for providing a vacuum to the container.

When the apparatus of the invention includes a vacuum/pressure pump, the line extending through the opening in the upper flange of the container is used to create a partial vacuum in the container or, alternatively, to apply pressure within the container. A float valve is present in the container for preventing overflow through this line of the container during filling of the container. When liquid entering the container fills the container to capacity, the float valve, which will have been caused to rise by the liquid, will close the open end of the pump line which extends into the container. The float valve also prevents liquid in the container from venting to the atmosphere. During filling of the container, air is being pumped from the container by a pump to create a vacuum in the container. Since the air may contain fumes from the previous batch of chemicals present in the container, a discharge hose is connected to the pump in relation to the line in communication with the container so as to allow venting of the system away from the operator. The discharge hose can be attached to an environmentally protective exhaust filter, placed in the same container into which the chemical outlet hose is placed, or introduced into a small container of water to alleviate fumes. The latter is suitable when the system is used with agri-chemicals since most agri-chemicals are formulated to emulsify in water.

To operate the closed, chemical transfer metering system when utilizing a vacuum/pressure pump, a partial vacuum is created in the container using the pump. The valve on the inlet hose to the container is opened allowing movement of a liquid from a supply container through the hose into the container of the closed system. The container is filled to a desired level utilizing the sight gauge. The float valve will prevent overfilling. When the container is filled to the desired level, the valve for the inlet line is closed and the pump switched so that the pump output creates pressure in the container. The valve on the outlet line is then opened to allow for discharge of the liquid into a sprayer tank, chemical mix tank or the like. The vacuum/pressure pump utilizes a motor in conjunction with an air pump and two 3-way valves in order to provide alternatively pressure or vacuum to the metering chamber. Due to the use of the two 3-way valves, a single lever can be utilized to control whether vacuum or pressure is provided. This provides for a simple and quick operation of the closed transfer system.

In the alternative embodiment in which a hand pump is utilized to create a partial vacuum in the container, the hand pump is not utilized to apply pressure to empty the chemical from the container and, therefore, the unit is placed on top of the container into which the chemical is being transferred and allowed to empty by the force of gravity. Due to the portable nature of the apparatus, it is readily positioned on the tank into which the chemical is being transferred. The hand pump includes a valve which serves to maintain the vacuum in the container until the valve is released at which time the vacuum is broken allowing for ready discharge of the material in the container. The inlet line for the container through which the chemical is transferred also contains a check valve so that the material being transferred will not flow back through the inlet hose. During operation of the system, the amount of chemical pulled into the container is controlled by the operation of the hand pump. When the desired amount of chemical is transferred into the container, the valve on the hand pump is opened thereby releasing the vacuum and allowing air to be introduced into the container. A valve on the outlet line connected to the container is then opened which allows the chemical to flow from the container by gravity into the apparatus to which it is being transferred.

DESCRIPTION OF THE PRESENTLY PREFERRED EMBODIMENTS

The self-contained, portable, closed, chemical transfer system of the present invention includes a support frame, a container, a means for supplying a vacuum to the container, a valved inlet line and a valved outlet line. Optionally, the vacuum supplying means can also be capable of providing pressure within the container. Additionally, the system preferably includes a leveling means for use with the container so that the system can be utilized at various angles or on different terrains and still be able to provide for an accurate metering of material. Additionally, the system includes an overflow prevention valve so that overfilling of the container is avoided.

In the preferred embodiment, a vacuum/pressure pump is utilized which provides for either a vacuum in the metering container or the supplying of pressure to the metering container. A vacuum is created in the container when the container is being filled with a chemical and pressure is applied when the chemical is being emptied from the container. Such action is controlled through the use of a single actuator means on the pump due to the use of two 3-way valves in the pump connected to appropriate air flow lines.

In an alternative embodiment, a hand pump is utilized to create a vacuum in the metering chamber. On emptying of the chamber, pressure is not applied, but rather the chemical is allowed to empty from the container through the use of gravity and the operation of two control valves.

Figures 1, 2, 5:
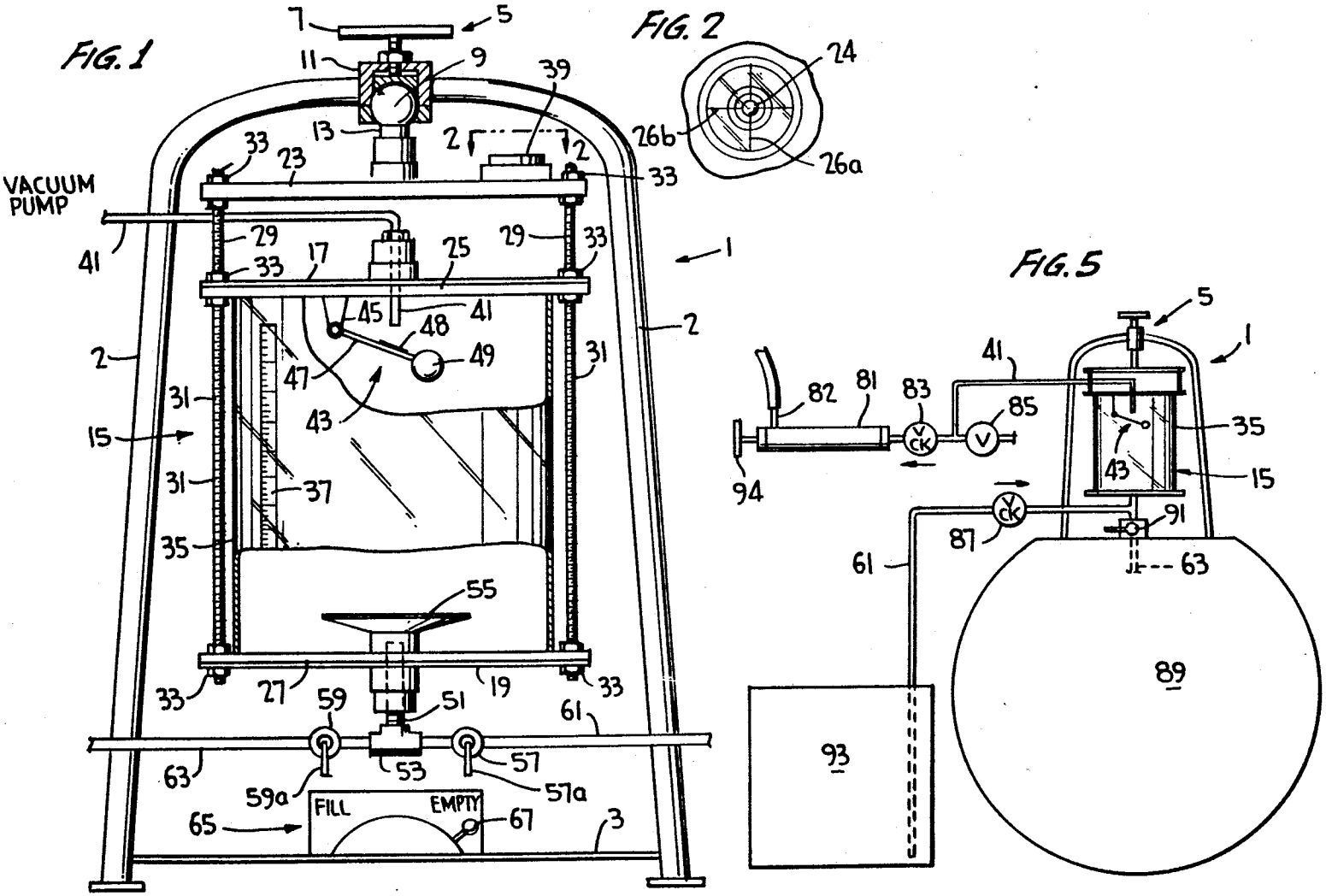
FIG. 1 is a front elevational view of a first embodiment of the chemical transfer system of the present invention which utilizes a vacuum/pressure pump.
FIG. 2 is a view along line 2—2 of FIG. 1 illustrating the float level indicator.
FIG. 5 is a schematic view of an alternative embodiment of the present invention wherein a hand-operated pump and valve are utilized to provide a vacuum in the container during the filling of the container with a liquid. The closed, chemical transfer system is shown positioned on top of a tank to which the liquid is being transferred.

More specifically, in relation to FIG. 1, the volumetric closed chemical transfer system of the present invention includes a frame 1, which is preferably a structure having four legs 2, only two of which are shown in FIG. 1. Frame 1 preferably includes support members 3 positioned between the legs of the frame to provide additional strength to the frame. Further, frame 1 has a leveling means 5 as a top structural member completing the frame. Leveling means 5 includes a handle 7 which is rotatably attached to a ball joint 9 positioned in a coupling member or housing 11 which is attached to legs 2 such as by welding or the like.

Attached to leveling means 5 through rotatable rigid member 13 is a metering container assembly 15. The container assembly 15 includes a first flange 23, a second flange 25, and a third flange 27. Flange 27 is held in place with respect to flange 25 and flange 23 through the use of a plurality of rigid rods 31 which extend through each flange and are held in place by the use of fastening means 33, which can be conventional bolts or the like. Rods 31 preferably are screw threaded allowing for easy adjustment and ready assembly of the unit. If desired, flange 23 can be held in spaced relation to flange 25 through the use of rigid tubular spacers as known in the art. However, to provide additional strength to flanges 25 and 27, it is preferable to use rigid rings 17 and 19 in relation to flanges 25 and 27. Rings 17 and 19 are preferably metal and will extend around the outside circumference of flanges 25 and 27 and be held in place by rods 31 and fasteners 33. Prior to assembly of the flanges in fitting relation, an open-ended container 35, which is preferably cylindrical, is positioned between flanges 25 and 27. Flanges 25 and 27 are caused to fit with the edge of the open ends of container 35 so that container 35 in conjunction with flanges 25 and 27 provide a leakproof container. Flanges 25 and 27 are preferably formed by molding. To provide a leakproof seal with container 35, flanges 25 and 27 can contain grooves (not shown) formed in the flanges for receiving the ends of container 35. Flanges 25 and 27 can be provided with grooves of varying diameters so that containers of different sizes can be utilized in the structure as desired. Alternatively, the flanges can be made from a material which, when the flanges are tightened in place through the use of rods 31 and fasteners 33, has adequate flexibility to provide an adequate seal between the surface of the flanges and the ends of container 35. Conventional sealing means as known in the art are also suitable for use therewith.

Flange 23 has a level indicator 39 positioned thereon which is utilized in conjunction with leveling means 5. When leveling means 5 is used to adjust the position of container 35, indicator 39 allows the operator to readily determine when the container is level. FIG. 2 shows a suitable level indicator, i.e. a ball float 24 which when positioned at the intersections of cross hairs 26*a* and 26*b* indicates that the container is level.

Flange 25 has an opening therein through which a tube line 41 extends. Line 41 thereby extends into the interior of container 35. A float or overflow valve 43 is positioned in relation to the end of line 41 present in container 35. Overflow valve 43 is suspended from flange 25 by a suitable member 45. Hingedly connected to member 45 is rigid element 47 having a float 49 on the end thereof. Rigid member 47 when pushed upward by liquid pressing on float 49 will serve to close line 41 extending into container 35. At the point rigid element 47 meets line 41, a seal material 48 is preferably present to better insure a leakproof seal with line 41.

Flange 27 additionally has a passage formed therein. A pipe connector 51 is connected to this passage and is attached to a 3-way valve 53. Positioned over pipe 51 as it passes through flange 27 is preferably a deflector means 55. Deflector means 55 serves to control the inflow of liquid through pipe 51 so that it does not splash upward into container 35. In particular, deflector means 55 prevents liquid from splashing upward and hitting float 49 thereby preventing any interference with line 41. Also attached to 3-way valve 53 is inlet line 61 and outlet line 63. Inlet line 61 is connected to valve 57 and outlet line 63 is connected to valve 59. Valves 57 and 59 are opened or closed utilizing handles 57*a* and 59*a*, respectively. Valves 57 and 59 are used to control the flow of liquid through lines 61 and 63 and thereby control the flow of liquid into and out of container 35.

Figure 3:
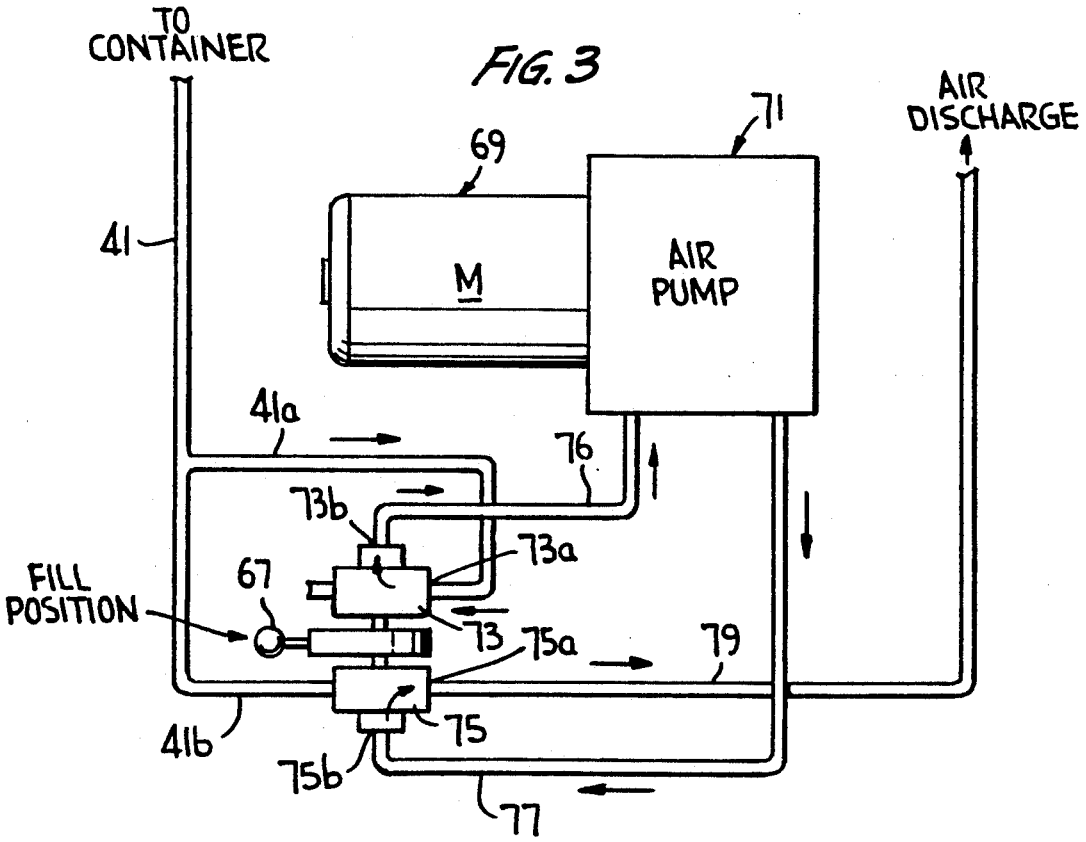
FIG. 3 is a schematic view of the vacuum/pressure pump of the apparatus showing the flow of air utilizing the two 3-way valve pump system of the present invention when the pump is providing a vacuum to the container during the filling of the container with a liquid.

Positioned for use with the system is a pump. Preferably, the pump is a vacuum/pressure pump 65 and is located in the base of the system. The pump can be positioned on top of support members 3 in a suitable manner so that the transfer system is easily movable. If the pump is automated, the pump will include a conventional on/off switch. The pump has a single lever 67 for controlling the filling and emptying operation of the pump. As shown in FIGS. 2 and 3, the pump includes a motor 69, an air pump 71, two 3-way valves 73 and 75, and lines 76 and 77 for connecting the air pump to the two 3-way valves 73 and 75. Also connected to valves 73 and 75 is line 41 which is in communication with container 35, and line 79 which is an air discharge line. Lever 67 is operatively joined in a conventional manner to valves 73 and 75 to control the openings in valves 73 and 75.

In operation of the portable, self-contained, closed, chemical transfer system, the frame is positioned on a suitable surface. Container 35 is leveled, if necessary, using leveling means 5 in conjunction with indicator 39. Handle 7 is turned until level 39 indicates that container 35 is level. Thereafter when a vacuum/pressure pump as described above is utilized, lever 67 on pump 65 is turned to the fill position so that motor 69 and air pump 71 will draw air through line 41 from container 35 thereby creating a partial vacuum in container 35. As shown in FIG. 3, pump 65, during the filling of container 35, draws air from container 35 through line 41, line 41*a*, valve 73, and line 76 as indicated in FIG. 2. As air is drawn out of container 35 through line 41 to air pump 71, air is simultaneously discharged by pump 71 through line 77, valve 75 and line 79. Lever 67 controls, in a conventional manner, the opening of valves 73 and 75 at ports 73*a*, 73*b*, 75*b*, and 75*a* to allow for the continuous flow of air through the above-described lines.

While a vacuum is being created in container 35, valve 59 is closed and valve 57 is opened to allow for the inflow of liquid through line 61 and pipe 51 into the interior of container 35. The vacuum allows for the ready entrance of liquid in the container since there is no air to displace or to cause blockage. Line 61 is connected at its free end (not shown in FIG. 1) to a container holding the liquid to be transferred.

If the liquid entering container 35 reaches the level of float 49, the liquid forces float 49 and thereby rigid member 47 to rise and close off line 41. This prevents the further drawing out of air and inflow of liquid. Further, escape of liquid from container 35 through line 41 is prevented.

Figure 4:
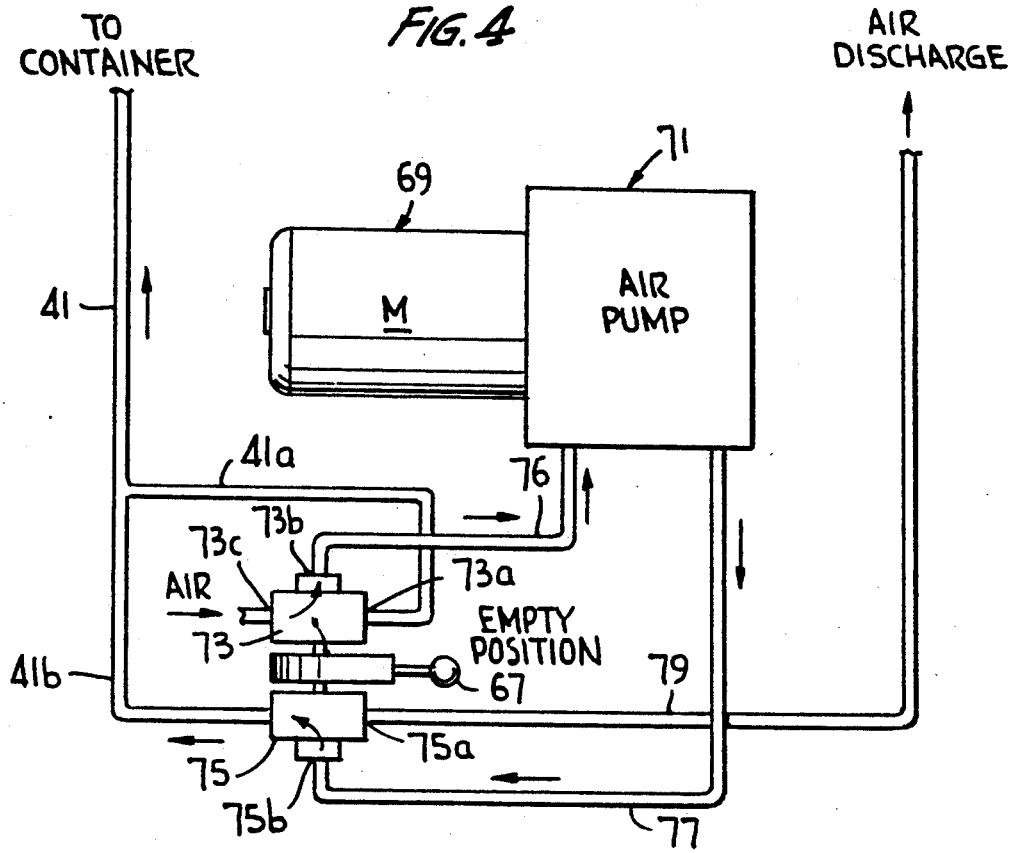
FIG. 4 is a schematic view of the vacuum/pressure pump of the present invention showing the flow of air when pressure is being supplied to the container during the emptying of a liquid from the container.

Once container 35 is filled to a desired level, which is readily determined using sight gauge 37, valve 57 is closed and lever 67 turned to the emptying position. By turning lever 67, valve port 73*a* and valve port 75*a* are closed and valve port 73*b* and valve port 75*b* are opened. The flow of the air during the emptying operation is shown in FIG. 4. Air is pumped by air pump 71 to container 35 to provide pressure to facilitate the discharge of liquid from container 35 through line 63. The free end of line 63 (not shown in FIG. 1) is connected to the container to which the collected liquid is to be transferred. Air is pumped into container 35 by drawing air from the ambient atmosphere into air pump 71 through valve port 73*c* and line 76. The air is then pumped through line 77, valve 75, line 41*b*, and line 41 into container 35. Valve 59 is opened when pump 65 is activated to the empty function so that the liquid within container 35 can exit through pipe 51, valve 53, and line 63 into the container which the liquid is desired to be transferred.

During the filling operation, so that any fumes from the liquid being transferred are not inhaled by the user of the system, air discharge line 79 can be connected to a conventional environmentally protective exhaust filter, placed into the container into which outlet line 63 is placed, or introduced into a small container of water to alleviate the fumes.

In a second preferred embodiment, if the vacuum/pressure pump as utilized in the above-described embodiment is not used, a hand pump can be utilized to create a vacuum with container 35. In this event, gravity will be utilized to facilitate the discharge of the metered liquid from container 35. The structure of the system with regard to the frame, leveling means, container assembly, etc. is the same as described above in relation to the first embodiment. The difference between the systems of the different embodiments relates to the pump means utilized and the pump operation.

More specifically, as shown in FIG. 5, the portable, self-contained, closed chemical transfer system utilizes the same frame 1, leveling means 5, overflow valve 43, container assembly 15, vacuum line 41, and inlet line 61. Rather than utilizing vacuum/pressure pump 65, however, the embodiment as shown in FIG. 5 utilizes a hand pump 81 in conjunction with a check valve 83 and valve 85. Additionally, in the second preferred embodiment, inlet line 61 contains a check valve 87 therein.

In use, the portable system of the alternative embodiment is placed on top of tank 89 into which a liquid from container 93 is to be transferred. Outlet valve 91 and valve 85 are closed during the filling of container 35. Line 61 is placed in a container 93 containing the liquid to be transferred into container 35 and thereafter into container 89. Pump handle 94 is then manually operated to draw air from container 35 and create a vacuum therein. The air is drawn out of container 35 through line 41 into pump 81 wherein it exits through line 82. To alleviate any fumes which may be present, line 82 can be connected to an environmentally protective filter, placed in container 93 or placed in a bucket of water. Liquid is then pulled into container 35 through line 61 pass check valve 87. Check valve 87 prevents the liquid fed into container 35 from exiting container 35 back into line 61. The amount of liquid pulled into container 35 is controlled through the use of hand pump 81. Check valve 83 serves to maintain the vacuum in container 35 during the air intake stroke of pump 81. When the desired amount of liquid has been transferred from container 93 into container 35, valve 85 is opened allowing air to enter line 41 and be introduced into container 35. Then valve 91 is opened allowing the liquid in container 35 to flow by gravity through line 63 into tank 89 thereby emptying container 35.

A conventional ball valve can be utilized in place of check valve 87. Additionally, rather than controlling the flow of liquid into container 35 solely by hand pump 81, a valve can be contained on line 61 to control the flow of liquid into container 35.

As will be apparent to one skilled in the art, various modifications can be made within the scope of the aforesaid description. Such modifications being within the ability of one skilled in the art form a part of the present invention and are embraced by the appended claims.

It is claimed:

1. A self-contained, readily portable, closed, chemical transfer system comprising a support frame, a container assembly, a valved inlet line, a valved outlet line, an air line connected to said container assembly at a first end of said air line, a means connected to a second end of said air line which is capable of drawing air from said container assembly through said air line so as to create a vacuum in said container assembly, and a means for leveling said container assembly wherein said means for leveling is an integral part of said support frame, has a locking mechanism by which said container assembly is attached to said leveling means and serves to adjust position of said container assembly in relation to said support frame so that material present in said container assembly can be adjusted to be horizontally level when said transfer system is positioned on a non-level surface.

2. A self-contained, portable, closed, chemical transfer system according to claim 1 wherein said means capable of drawing air from said container assembly is also capable of providing pressure within said container assembly.

3. A self-contained, portable, closed chemical transfer system according to claim 2 wherein said means capable of drawing air and providing pressure comprises a power means, an air pump, a first 3-way valve, a second 3-way valve, and lines to operatively connect said container assembly, said first and second 3-way valves and said air pump.

4. A self-contained, portable, closed, chemical transfer system comprising a support frame, a container assembly, a valved inlet line, a valved outlet line, an air line connected to said container assembly at a first end of said air line, and a pump means connected to a second end of said air line which is capable of alternately drawing air from said container assembly to create a vacuum in said container assembly or forcing air into said container to provide pressure within said container assembly, wherein said pump means comprises a motor, an air pump, a first 3-way valve operatively and mechanically connected to a second 3- way valve so as to provide an integral 6-way valve operable by a single actuator means operatively connected to said first 3-way valve and said second 3-way valve so that said first 3-way valve and said second 3-way valve operate in conjunction with each other to control the flow of material through said transfer system, and lines to operatively connect said container assembly, said first and second 3-way valves and said air pump.

5. A self-contained, portable, closed, chemical transfer system according to claim 4 further comprising a means for leveling said container assembly.

6. A self-contained, portable, closed, chemical transfer system according to claim 1 or claim 4 further comprising a float valve within said container assembly capable of sealing off said air line connected to said container assembly.

7. A self-contained, portable, closed, chemical transfer system according to claim 1 or claim 4 wherein said container assembly comprises a container, a plurality of flanges and a plurality of rigid rods wherein said flanges and said rods serve to hold said container in spaced relation to said support frame and are capable of holding a container of varying size in a leakproof manner.

8. A self-contained, portable, closed, chemical transfer system comprising a support frame, a container assembly, a valved inlet line, a valved outlet line, an air line connected to said container assembly at a first end of said air line and a hand pump means connected to a second end of said air line capable of drawing air from said container assembly through said air line so as to create a vacuum in said container assembly, and a means for leveling said container assembly wherein said means for leveling is an integral part of said support frame, has a locking mechanism by which said container assembly is attached to said leveling means and serves to adjust position of said container assembly in relation to said support frame so that material present in said container assembly can be adjusted to be horizontally level when said transfer system is positioned on a non-level surface.

* * * * *